US007014411B2

(12) United States Patent
Westendorf et al.

(10) Patent No.: US 7,014,411 B2
(45) Date of Patent: Mar. 21, 2006

(54) FRONT END LOADER, TRACTOR, AND METHOD FOR ATTACHING A FRONT END LOADER

(75) Inventors: Neal W. Westendorf, Dakota Dunes, SD (US); Joseph W. Langenfeld, Onawa, IA (US); Mitch Gibler, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 10/608,896

(22) Filed: Jun. 23, 2003

(65) Prior Publication Data

US 2004/0042888 A1 Mar. 4, 2004

Related U.S. Application Data

(63) Continuation-in-part of application No. 09/639,039, filed on Aug. 15, 2000, now Pat. No. 6,582,177.

(51) Int. Cl.
*E02F 3/627* (2006.01)

(52) U.S. Cl. ..... 414/686; 172/275

(58) Field of Classification Search ..... 414/686; 172/272, 273, 274, 275

See application file for complete search history.

(56) References Cited

U.S. PATENT DOCUMENTS

| | | | |
|---|---|---|---|
| 2,326,338 | A | 8/1943 | Drott et al. |
| 2,812,595 | A | 11/1957 | Drott et al. |
| 3,077,999 | A | 2/1963 | Svoboda |
| 3,209,474 | A | 10/1965 | Artman |
| 3,243,905 | A | 4/1966 | Ulrich |
| 3,344,540 | A | 10/1967 | Ulrich |
| 3,455,477 | A | 7/1969 | Blair |
| 3,512,665 | A | 5/1970 | Westendorf |
| 3,701,443 | A | 10/1972 | Lely |
| 3,991,890 | A | 11/1976 | Frank |
| 4,033,469 | A | 7/1977 | Frank |
| 4,051,962 | A | 10/1977 | Westendorf |
| 4,085,856 | A | 4/1978 | Westendorf |
| 4,345,870 | A | 8/1982 | Anderson et al. |
| 4,538,955 | A | 9/1985 | Langenfeld et al. |
| 4,565,485 | A | 1/1986 | Wilman |

(Continued)

FOREIGN PATENT DOCUMENTS

JP 11-269907 * 5/1999 ..... 414/686

*Primary Examiner*—Donald W. Underwood
(74) *Attorney, Agent, or Firm*—Merchant & Gould P.C.

(57) ABSTRACT

A front end loader is provided according to the invention. The front end loader includes a forward bracket assembly and a rear bracket assembly, a tower that attaches to the rear bracket assembly, and a tower subframe that attaches to the forward bracket assembly. The tower has a first tower end and a second tower end. The second tower end includes a shoe area for attaching to a shoe-receiving region provided on the first bracket assembly. The tower subframe has a first tower subframe end and a second tower subframe end. The first tower subframe end is attached to the tower, and the second tower subframe end is constructed for attachment to the second bracket assembly. A spring can be provided as part of the rear bracket assembly to reduce rattling between the tower and the rear bracket assembly. The rear bracket assembly can be referred to as the first bracket assembly, and the forward bracket assembly can be referred to as the second bracket assembly. A tractor and a method for attaching a front end load to a tractor are provided.

4 Claims, 14 Drawing Sheets

U.S. PATENT DOCUMENTS

| | | | | |
|---|---|---|---|---|
| 4,566,844 | A | | 1/1986 | Campin |
| 4,606,692 | A | | 8/1986 | Langenfeld et al. |
| 4,787,811 | A | | 11/1988 | Langenfeld et al. |
| 4,790,084 | A | | 12/1988 | Anderson et al. |
| 4,797,051 | A | | 1/1989 | Langenfeld et al. |
| 4,859,130 | A | | 8/1989 | Langenfeld et al. |
| 4,890,400 | A | | 1/1990 | Long |
| 4,915,575 | A | | 4/1990 | Langenfeld et al. |
| 4,930,974 | A | | 6/1990 | Langenfeld et al. |
| 4,968,213 | A | | 11/1990 | Langenfeld et al. |
| 4,995,760 | A | | 2/1991 | Probst et al. |
| 5,121,557 | A | | 6/1992 | Moore |
| 5,387,076 | A | | 2/1995 | Fuzzen |
| 5,466,113 | A | | 11/1995 | Norberg |
| 5,536,134 | A | * | 7/1996 | Hirooka ..... 414/686 |
| 5,785,328 | A | | 7/1998 | Eckloff |
| 5,997,237 | A | | 12/1999 | Langenfeld et al. |
| 6,142,724 | A | | 11/2000 | Hirooka et al. |
| 6,582,177 | B1 | | 6/2003 | Westendorf et al. |

* cited by examiner 142
140
138
132
46
134
146
144
134
148
150
152

FIGF. 12C
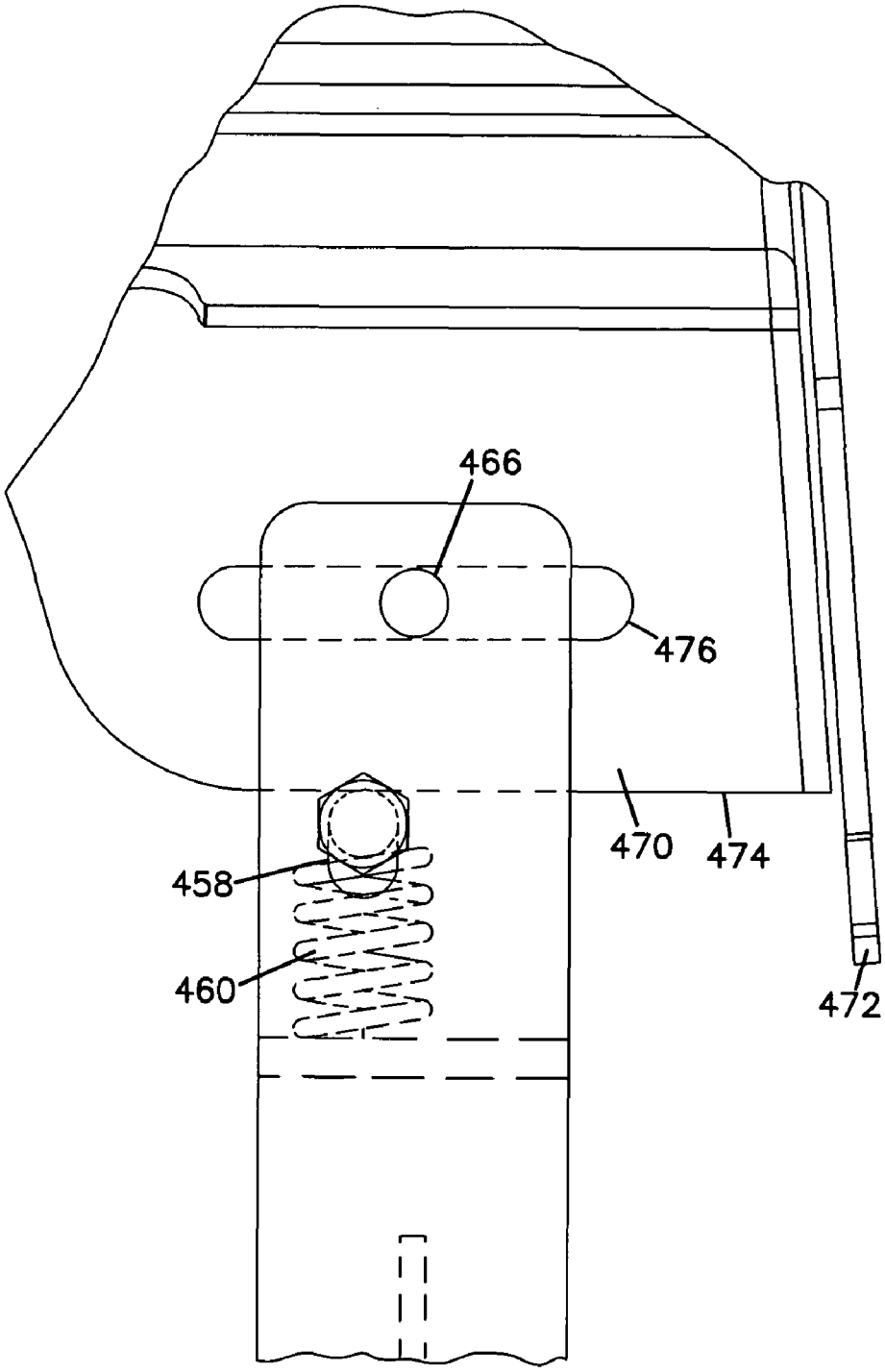

FRONT END LOADER, TRACTOR, AND METHOD FOR ATTACHING A FRONT END LOADER

CROSS-REFERENCE TO RELATED APPLICATION

This application is a continuation-in-part application of U.S. application Ser. No. 09/639,039 that was filed with the United States Patent and Trademark Office on Aug. 15, 2000 and issued as U.S. Pat. No. 6,582,177 on Jun. 24, 2003. The entire disclosure of U.S. application Ser. No. 09/639,039 is incorporated herein by reference.

FIELD OF THE INVENTION

The invention relates to front end loaders, tractors having a front end loader, and methods for attaching a front end loader.

BACKGROUND OF THE INVENTION

Conventional front end loaders have a pair of booms pivotally secured at their rearward ends to the tractor and pivotally secured at their forward ends to an attachment. Typical attachments used on front end loaders include buckets, clam shells, plow, fork lift, bale spear, etc. Hydraulic cylinders are usually pivotally connected to the rearward end of the attachment. Exemplary front end loaders are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf; U.S. Pat. No. 4,606,692 to Langenfeld et al.; and U.S. Pat. No. 4,930,974 to Langenfeld et al.

SUMMARY OF THE INVENTION

A front end loader is provided according to the invention. The front end loader includes a forward bracket assembly and a rear bracket assembly, a tower that attaches to the rear bracket assembly, and a tower subframe that attaches to the forward bracket assembly. The tower has a first tower end and a second tower end. The second tower end includes a shoe area for attaching to a shoe-receiving region provided on the first bracket assembly. The tower subframe has a first tower subframe end and a second tower subframe end. The first tower subframe end is attached to the tower, and the second tower subframe end is constructed for attachment to the second bracket assembly. A spring can be provided as part of the rear bracket assembly to reduce rattling between the tower and the rear bracket assembly. The rear bracket assembly can be referred to as the first bracket assembly, and the forward bracket assembly can be referred to as the second bracket assembly.

A tractor is provided according to the invention. The tractor includes the front end loader having the second tower end attached to the first bracket assembly, and the second tower subframe end attached to the second bracket assembly. The first bracket assembly and the second bracket assembly are attached to the tractor.

A method for attaching a front end loader to a tractor is provided according to the invention. The method includes a step of driving a tractor into a stationary front end loader, and then attaching the second tower end to the first bracket assembly, and attaching the second tower subframe end to the second bracket assembly.

DETAILED DESCRIPTION OF THE PREFERRED EMBODIMENT

Figure 1:
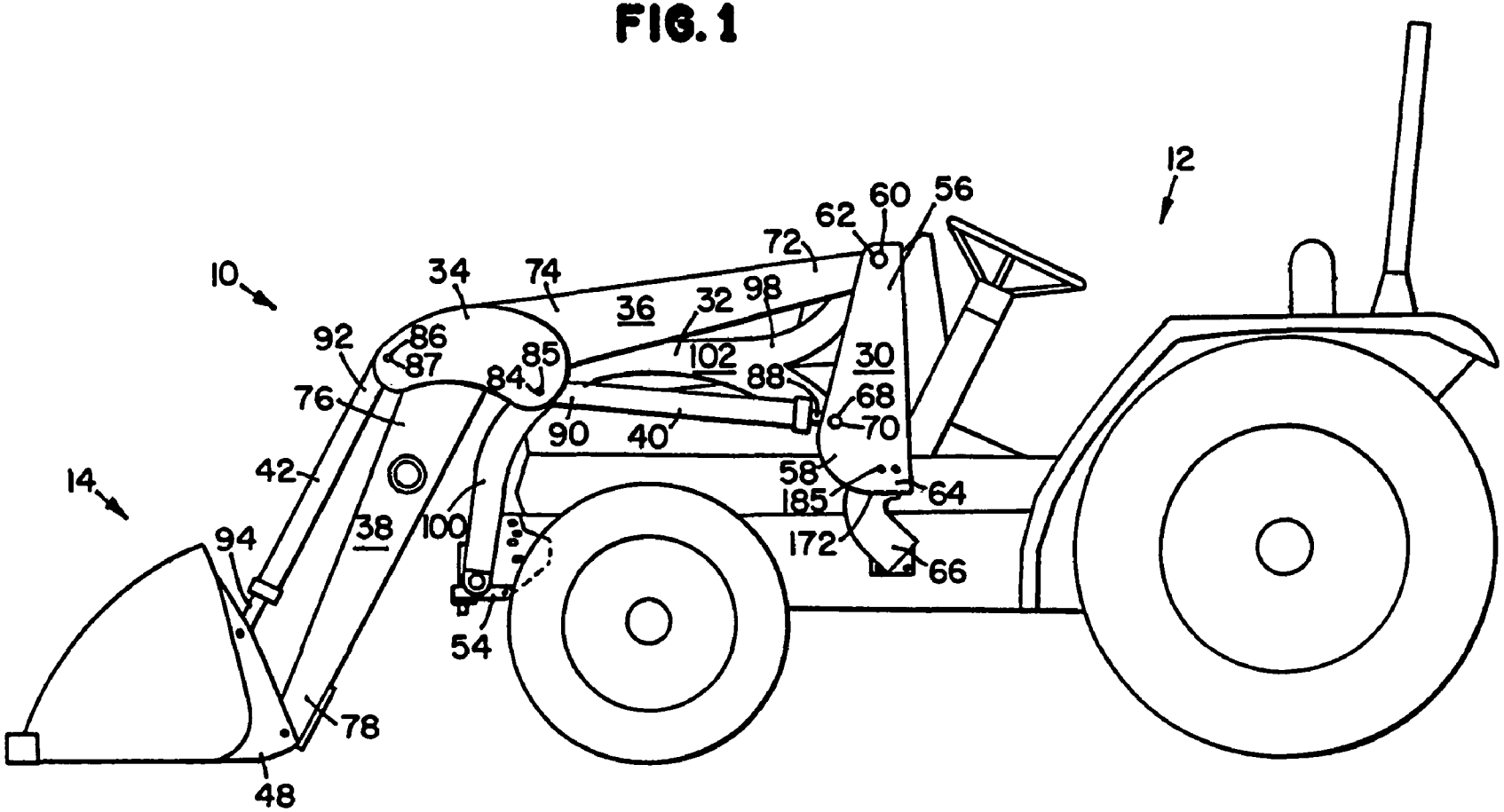
FIG. 1 is a side view of a tractor having a front end loader mounted thereon according to the principles of the invention.
Figure 2:
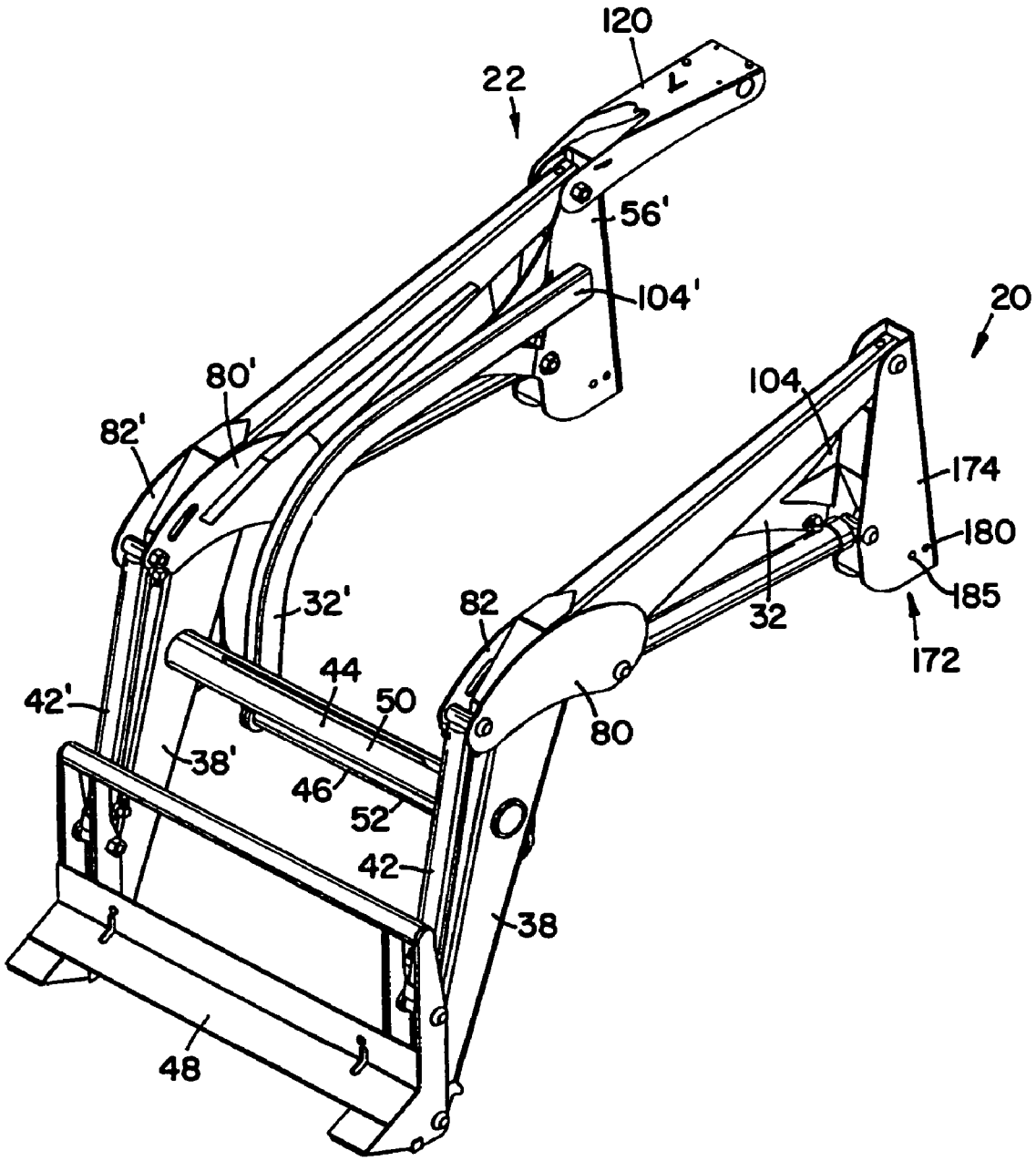
FIG. 2 is a perspective view of the front end loader of FIG. 1.
Figure 3:
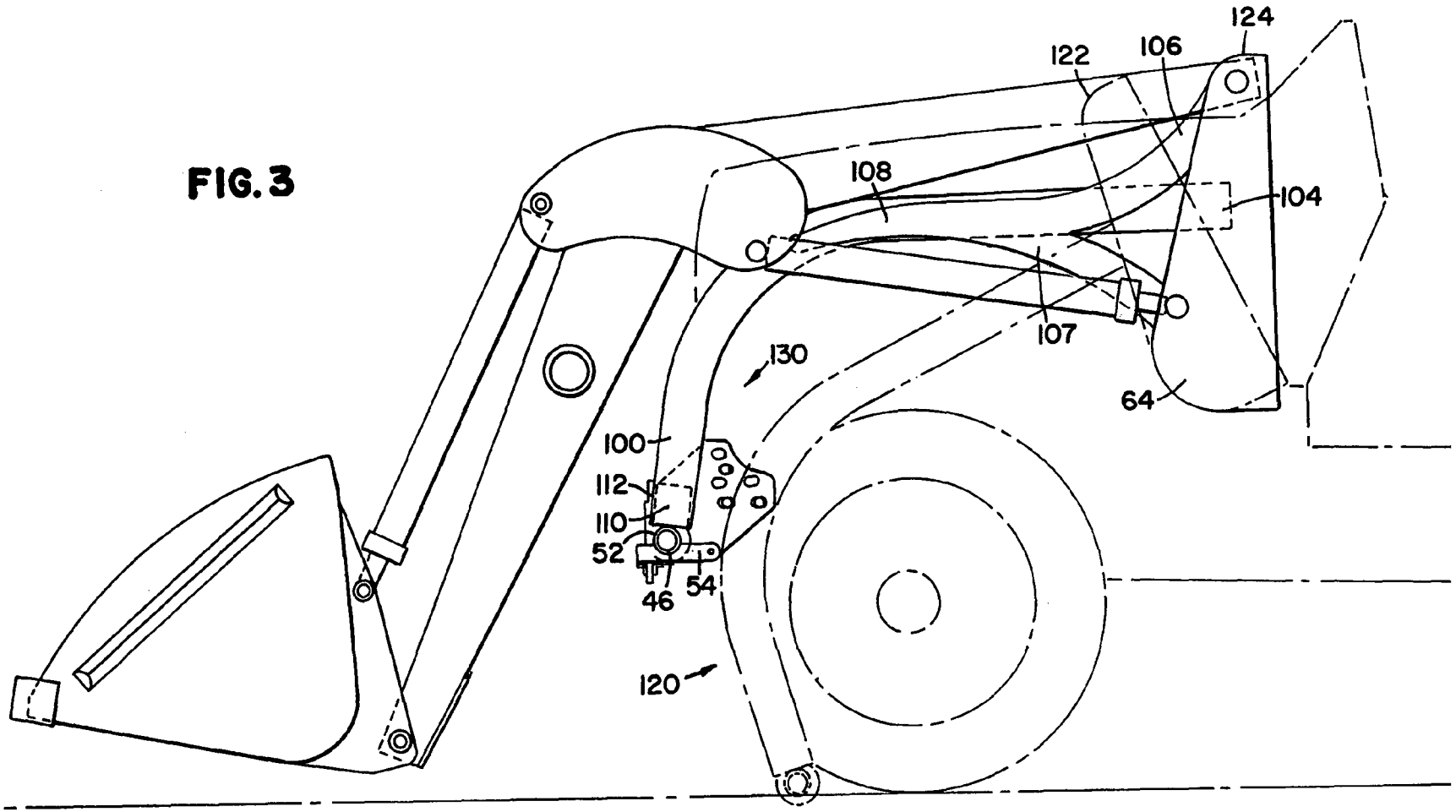
FIG. 3 is a side view demonstrating the attachment and detachment of the front end loader of FIG. 1.

A front end loader according to the invention is shown in FIGS. 1–3 at reference numeral 10. The front end loader 10 is shown attached to a tractor 12 and an attachment 14. The attachment 14 is shown as a bucket 16. The attachment 14 can be any other conventional attachment for use on a front end loader. Exemplary attachments include plows, forklifts, bale spears, clam shell buckets, etc. The front end loader 10 can be referred to more simply as the loader.

As shown in FIG. 2, the front end loader 10 includes a left boom arm 20 and a right boom arm 22 that generally include corresponding structure. The left boom arm 20 and the right boom arm 22 can be referred to as the first boom arm 20 and the second boom arm 22. There may be certain differences between the structure of the left boom arm 20 and the right boom arm 22. In general, the following discussion will refer to structure that is present on both the left boom arm 20 and the right boom arm 22. Corresponding structure, when identified, will be characterized on the right boom arm 22 using the same reference number used on the left boom arm 20, except that the reference numerals identifying corresponding structure on the right boom arm 22 will include an apostrophe.

The loader 10 includes a tower 30, a tower subframe 32, a knee 34, a loader arm 36, a front arm 38, a lift cylinder 40, and an attachment cylinder 42. As shown in FIG. 2, each of these components is provided on the left boom arm 20 and the right boom arm 22. As shown in FIG. 2, the left boom arm 20 and the right boom arm 22 are connected together by the stabilizing arm 44, the attachment arm 46, and the attachment device 48. The stabilizing arm 44 is preferably a pipe 50 that extends between the front arm 38 and the front arm 38'. The attachment arm 46 is preferably a pipe 52 extending between the tower subframe 32 and the tower subframe 32'. The attachment device 48 attaches the front arm 38 and 38' and the attachment cylinder 42 and 42' to the attachment 14. Although the front end loader 10 is shown having the attachment device 48, it should be appreciated that the front end loader 10 can be attached directly to an attachment 14 without the use of the attachment device 48. The attachment device 48 is desirable because it provides quick attaching and detaching to various attachments normally found on front end loaders.

The tower 30 and the tower subframe 32 are attached together. The tower 30 includes a first tower end 56 and a second tower end 58. The first tower end 56 includes an axis 60 for rotatable attachment to the loader arm 36. The axis 60 preferably includes a pin 62 that allows for rotation of the loader arm 36. The second tower end 58 includes a shoe area 64 for attachment of the tower 30 to the rear bracket assembly 66 that is attached to the tractor 12. The second tower end 58 additionally includes an axis 68 for rotatable attachment to the lift cylinder 40. Preferably, the axis 68 includes a pin 70 that allows rotation between the tower 30 and the lift cylinder 40.

The loader arm 36 includes a first loader arm end 72 and a second loader arm end 74. The first loader arm end 72 is rotatably attached to the first tower end 56 about the axis 60. The second loader arm end 74 is attached to the knee 34.

The front arm 38 includes a first front arm end 76 and a second front arm end 78. The first front arm end 76 is attached to the knee 34. The second front arm end 78 is provided for attaching to the attachment 14. Preferably, the second front arm end 78 is provided for attaching to the attachment device 48 that then attaches to the attachment 14.

The knee 34, the loader arm 36, and the front arm 38 are attached together to provide a structure that is sufficient to support the stresses normally encountered during the operation of a front end loader. As shown in FIG. 2, the knee 34 includes a first plate 80 and a second plate 82. The second loader arm end 74 and the first front arm end 76 are attached together between the first plate 80 and the second plate 82. Preferably, the attachment between the loader arm 36, the front arm 38, and the knee 34 is a weld attachment.

The knee 34 includes a first knee rotation axis 84 and a second knee rotation axis 86. Preferably, the first knee rotation axis 84 includes a pin 85 and the second knee rotation axis 86 includes a pin 87. The rotation preferably is provided about the pins 85 and 87. The lift cylinder 40 is provided for generating lift of the attachment 14. The lift cylinder 40 includes a first lift cylinder end 88 and a second lift cylinder end 90. The first lift cylinder end 88 attaches to the tower 30 at the axis 68. The second lift cylinder end 90 attaches to the knee at the first knee rotation axis 84. The attachment cylinder 42 is provided for controlling the movement of the attachment 14. The attachment cylinder 42 includes a first attachment cylinder end 92 and a second attachment cylinder end 94. The first attachment cylinder end 92 is provided attached to the second knee rotation axis 86. The second attachment cylinder end 94 is provided attached to the attachment 14 via the attachment device 48.

The attachment device 48 can be any device that provides connection between the attachment 14 and either or both of the second attachment cylinder end 94 and the second front arm end 78. It should be understood that the attachment device 48 may be a part of the attachment 14 or it may be a separate structure for attaching to the attachment 14. The attachment device 48 can be referred to as a quick attachment device 96 because it provides for convenient attaching and detaching from the attachment 14. Exemplary quick attachment devices are described in U.S. Pat. No. 3,512,665 to Westendorf; U.S. Pat. No. 4,085,856 to Westendorf; U.S. Pat. No. 4,787,811 to Langenfeld et al.; U.S. Pat. No. 4,859,130 to Langenfeld et al.; U.S. Pat. No. 4,915,575 to Langenfeld et al.; and U.S. Pat. No. 4,968,213 to Langenfeld et al. The disclosures of these patents are incorporated herein by reference.

The tower subframe 32 is provided attached to the tower 30. Preferably, the attachment is by welding. The tower subframe 32 includes a first tower subframe end 98 and a second tower subframe end 100. The first tower subframe end 98 attaches to the tower 30, and the second tower subframe end 100 is attached to the attachment arm 46 that is provided for attaching to the front bracket assembly 54. In addition to providing for attachment to the front bracket assembly 54, the tower subframe 32 is constructed to assist in the attachment of the tower 30 to the rear bracket assembly 66.

Now referring to FIG. 3, the operation of the tower 30 and tower subframe 32 is shown during an assembly disassembly operation. The tower 30 and tower subframe 32 are shown in solid lines when attached to a tractor, and are shown in dotted lines detached from a tractor and resting on the ground. The second tower subframe end 100 includes a cap 110 provided for attaching the second tower subframe end 100 to the attachment arm 46. Preferably, the cap 110 is provided within the hollow opening 112 provided within the second tower subframe end 100. Preferably, the cap 110 is welded within the hollow opening 112. The cap 110 is preferably a series of plates 114 welded together to provide sufficient structure for insertion within the hollow opening 112 and for providing secure attachment to the attachment arm 46.

The tower subframe 32 is constructed having a split bracket 102 attached to the subassembly arm 104. The subassembly arm 104 extends from the cap 110 to the tower 30. Preferably, the subassembly arm 104 is welded to the tower 30. The split bracket 102 is provided for reinforcing the connection between the subassembly arm 104 and the tower 30. Preferably, the split bracket 102 is in the form of a Y having a first arm 106 attached to the first tower end 56, and a second arm 107 attached to the second tower end 58. Preferably, the attachment is by welding. The split bracket 102 includes an arm extension 108 that extends along the subassembly arm 104, and is preferably welded to the subassembly arm 104. Preferably, the arm extension 108 is tapered along the subassembly arm 104. This taper, shown in FIG. 3, helps evenly distribute the stress along the subassembly arm 104.

The front end loader 10 is provided in a resting position 120 when the second tower subframe end 100 is provided resting on the ground. The tractor 12 moves forward in the direction of the arrow shown in FIG. 3 and the rear bracket assembly 66 engages the shoe area 64 of the tower 30. Continued movement forward of the tractor 12 causes the tower 30 to move from an inclined position 122 to a relatively vertical position 124. This, in turn, causes lifting of the tower subframe 32 so that the attachment arm 46 can engage the front bracket assembly 54. Once the tower 30 is secured to the rear bracket assembly 66 and the tower subframe 32 is secured to the front bracket assembly 54, the front end loader can be characterized as being in a working position 130. In order to detach the front end loader 10 from the tractor 12, the steps are reversed. That is, the tower 30 is released from the rear bracket assembly 66, the tower subframe 32 is released from the front bracket assembly 54, and the tractor is backed away from the front end loader 10. It should be understood that the pneumatic lines for operating the lift cylinder 40 and the attachment cylinder 42 are not shown. The pneumatic lines are generally attached to the tractor and the cylinder. Accordingly, in order to attach and detach the front end loader, it is often appropriate to attach or detach the pneumatic lines. In general, the pneumatic lines can be attached prior to attaching the front end loader 10 to the tractor, and can be detached just after detaching the front end loader 10 from the tractor 12.

Now referring to FIG. 2, the loader 10 includes a valve cover 120 provided attached to the right boom arm 22 at the first tower end 56'. The valve cover 120 is generally provided for covering the valves associated with the pneumatic lines. In addition, a lever (not shown) can be provided in association with the valve cover 120 to operate the cylinders.

Figure 4:
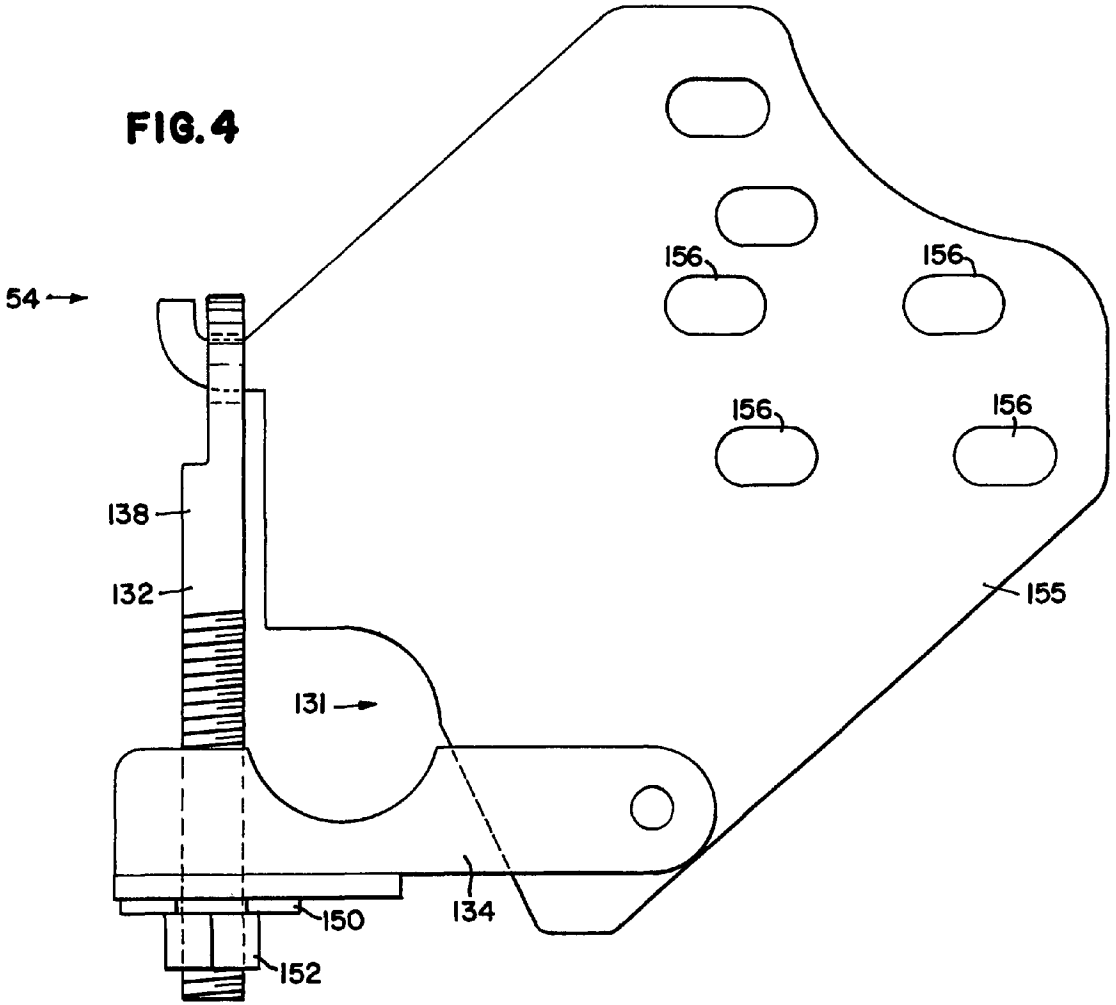
FIG. 4 is a side view of the front bracket for attaching the front end loader of FIG. 1 to the tractor.
Figure 5:
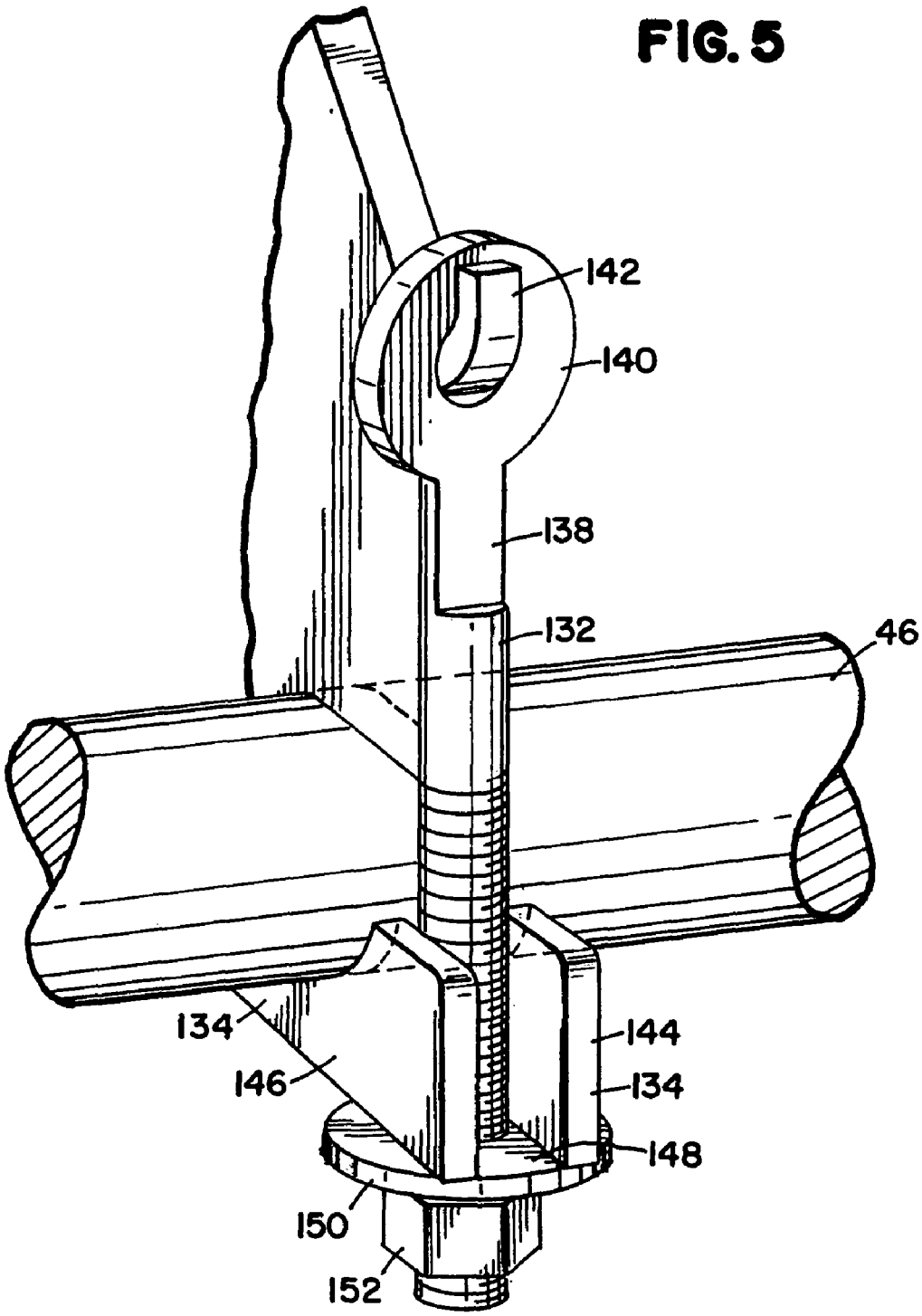
FIG. 5 is a perspective view of the front bracket for attaching the front end loader of FIG. 1 to the tractor.
Figure 6:
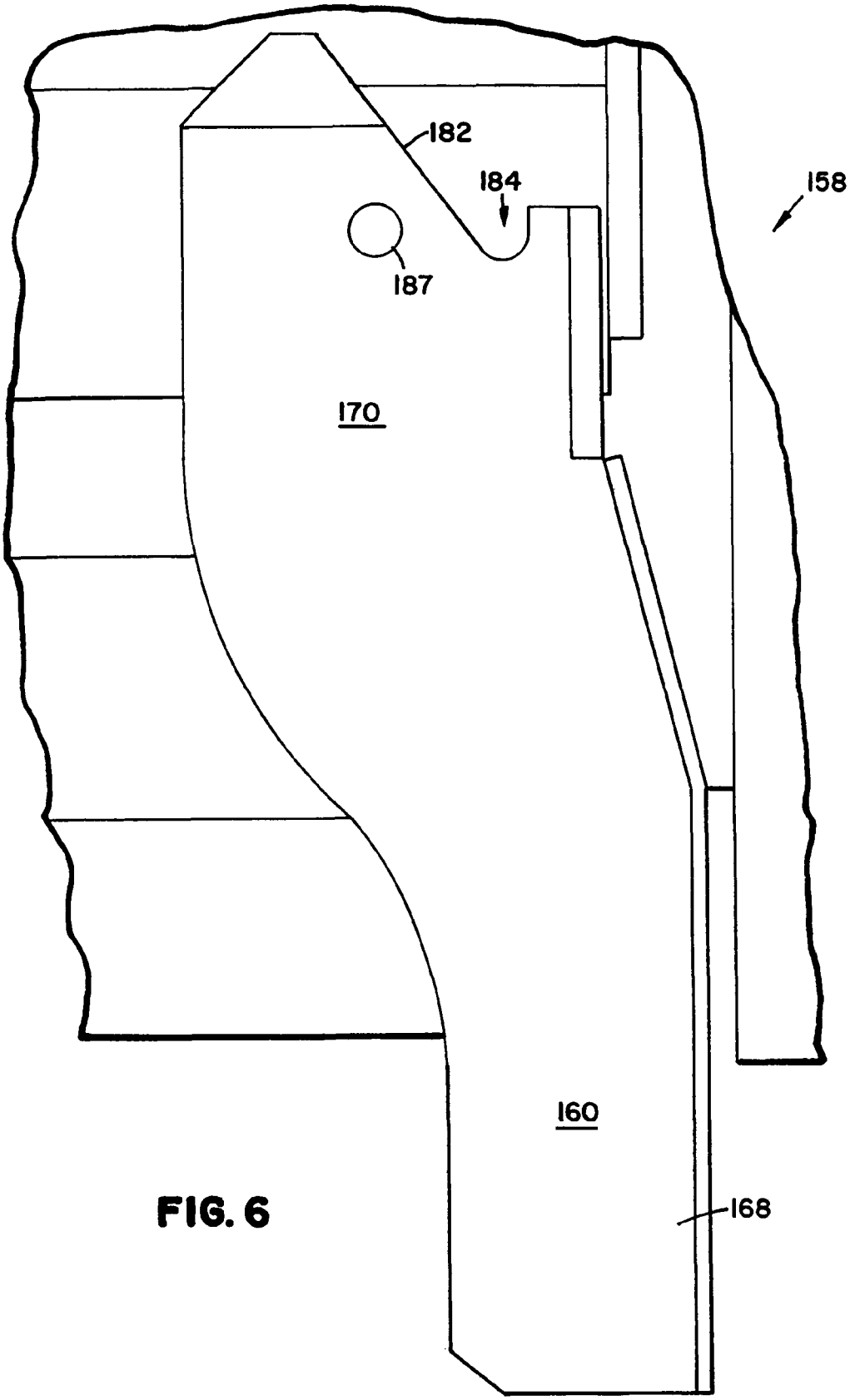
FIG. 6 is a side view of a rear bracket for attaching the front end loader of FIG. 1 to the tractor.
Figure 7:
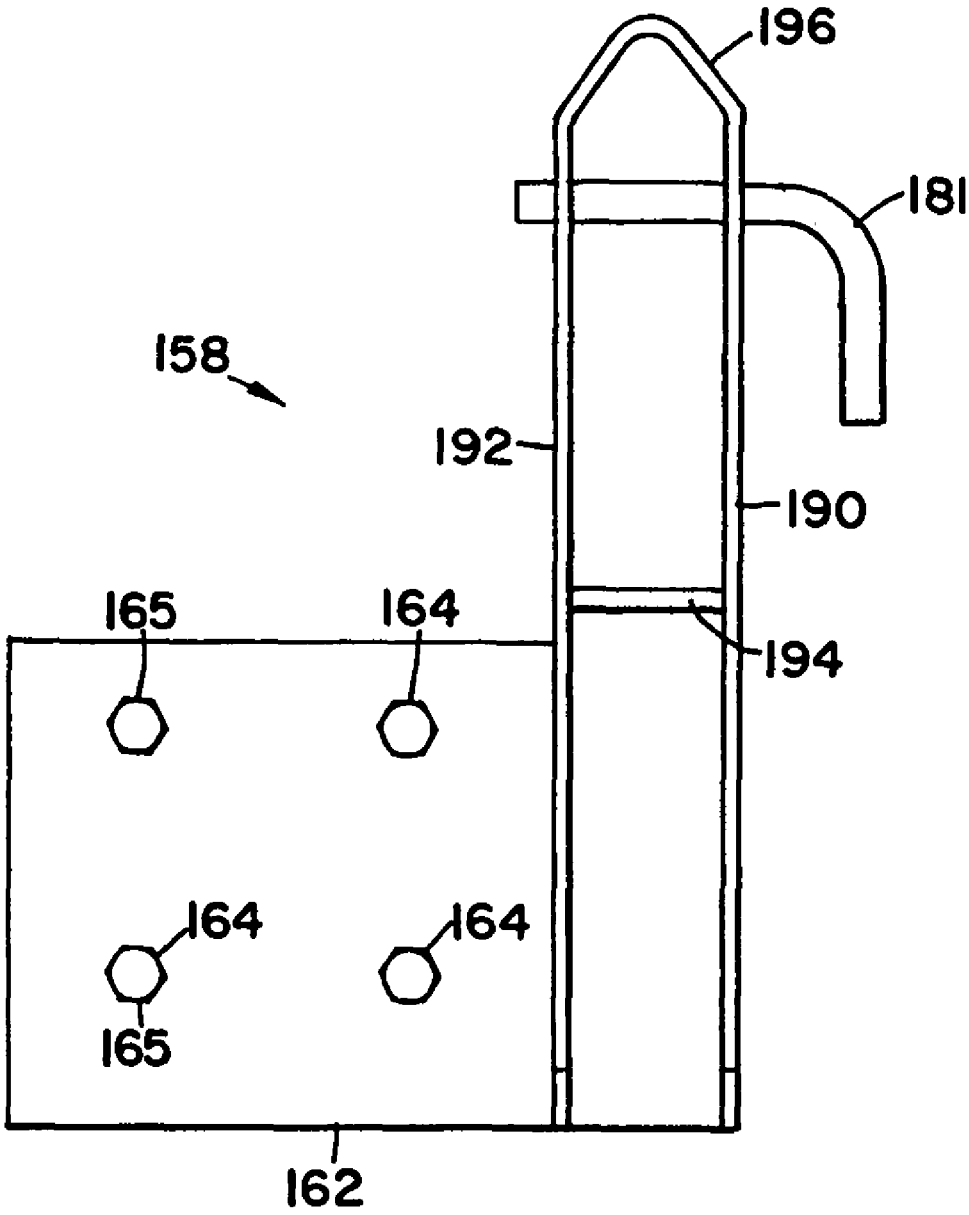
FIG. 7 is a side view of a rear bracket for attaching the front end loader of FIG. 1 to a tractor.

Now referring to FIGS. 4–5, the operation of the front bracket assembly 54 is shown in detail. During the attachment process, the attachment arm 46 moves into the attachment arm receiving area 131. During attachment, the bolt 132 is removed and the swing arm 134 rotates about the swing arm axis 136. Accordingly, once the attachment arm 46 is provided within the attachment arm receiving area 131, the swing arm 134 is rotated upward to engage the attachment arm 46, and the bolt 132 is replaced and attached to hold the swing arm 134 in place. Preferably, the bolt 132 is an I-bolt 138 having an I portion 140 that threads over a hanger 142. The bolt 132 then extends between the first side 144 and the second side 146 of the swing arm 134. The swing arm 134 includes a slotted area 148 that allows the bolt to move between the first side 144 and the second side 146. A washer 150 and a nut 152 can be provided for holding the bolt 132 in place. Although a bolt is shown holding the swing arm 134 in place, it should be appreciated that any other fastening mechanism can be used for holding the swing arm 134 in place in order to contain the attachment arm 46 within the attachment arm receiving area 131.

The front bracket assembly 54 includes a bracket member 155 for attachment to the tractor 12. The bracket member 155 includes openings 156 for receiving fasteners for attaching the bracket member 155 to the tractor 12. Preferably, the fasteners include bolt and nut type fasteners.

Now referring to FIGS. 6–10, the operation of exemplary rear bracket assemblies are shown in detail. The rear bracket assembly 158 includes a post 160 and a bracket member 162 for attaching the post 160 to the tractor. Preferably, the bracket member 162 is attached to the tractor by fasteners 164 such as nut and bolt type fasteners 165.

The post 160 includes a bracket attachment region 168 and a shoe-receiving region 170. The bracket attachment region 168 attaches to the bracket member 162. The shoe-receiving region 170 is constructed to fit within the shoe area 64 of the tower 30. As shown in FIGS. 1 and 2, the tower 30 is generally constructed to provide a bottom opening 172. The opening 172 provides for insertion of the shoe-receiving region 170 therein. The tower is preferably provided as a three-sided structure 174. In addition, the tower includes a fixed pin 180 and a removable pin 181. During the process of attaching the loader 10 to the tractor, the shoe-receiving area 170 engages the shoe area 64 of the tower 30. The fixed pin 180 engages the receiving surface 182 and moves along the receiving surface 182 until it reaches the fixed pin-receiving area 184. The fixed pin-receiving area 184 is provided to align the tower 30 both vertically and horizontally over the shoe-receiving region 170. The removable pin 181 can then be inserted into the opening 185 provided on the tower and engage the opening 187 provided in the shoe-receiving region 170. A cotter pin can then be used to keep the removable pin 181 in place. Once the removable pin 181 is provided extending through both sides of the tower 30, the tower is attached to the rear bracket assembly.

The post 160 is preferably provided having a first side 190 and a second side 192 that is separated by a distance that is sufficient to lock the tower 30 in place over the shoe-receiving region 170. The sides 190 and 192 can be attached by the support structure 194. In addition, the sides 190 and 192 can be attached by a peak or cap 196. The peak or cap 196 helps guide the tower 30 over the shoe-receiving region 170. The removable pin 181 and the fixed pin 180 extend between the sides 190 and 192.

Figure 8A:
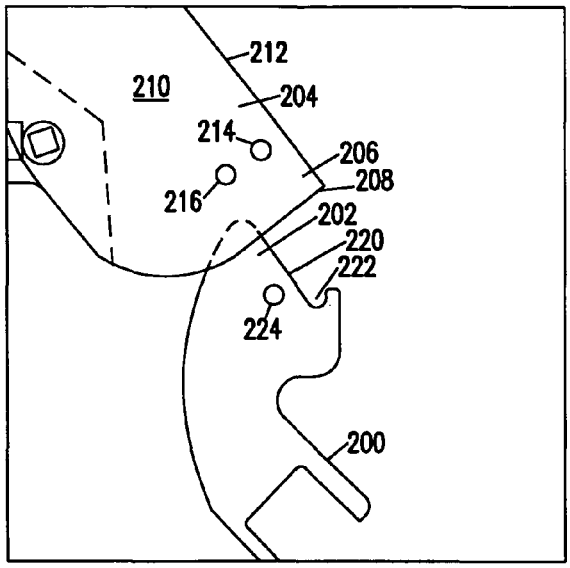
FIGS. 8(*a*)–(*c*) is a side view showing the attachment of a tower to a rear bracket according to principles of the invention.
Figure 8B:
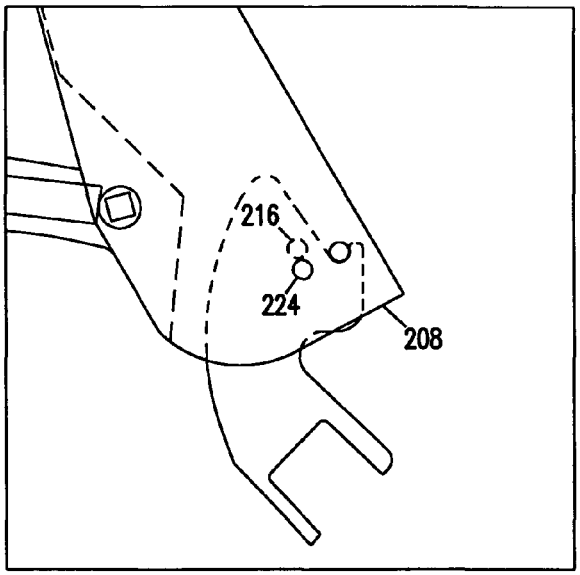
Figure 8C:
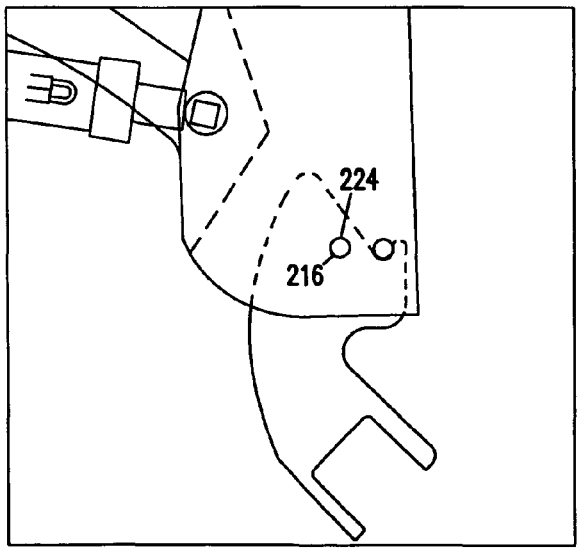
Figure 9A:
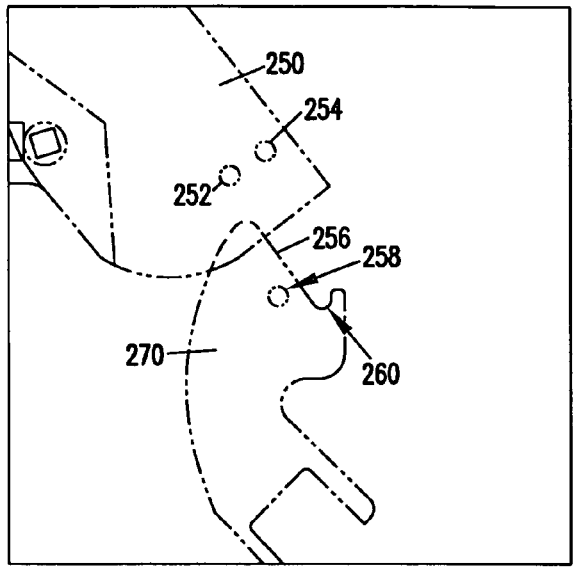
FIGS. 9(*a*)–(*c*) is a side view showing the attachment of a tower to a rear bracket according to principles of the invention.
Figure 9B:
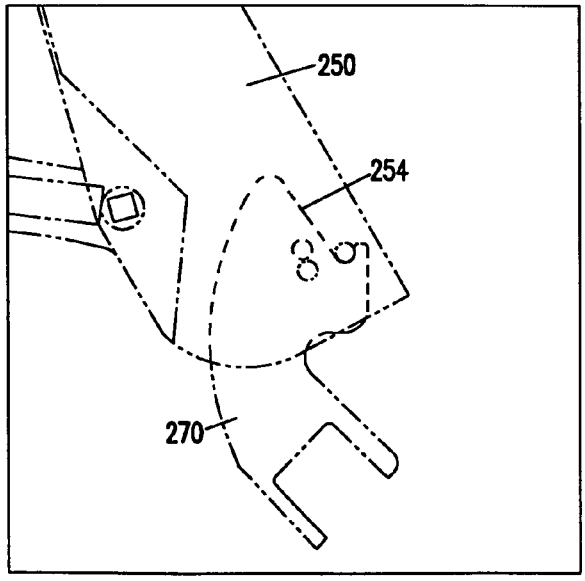
Figure 9C:
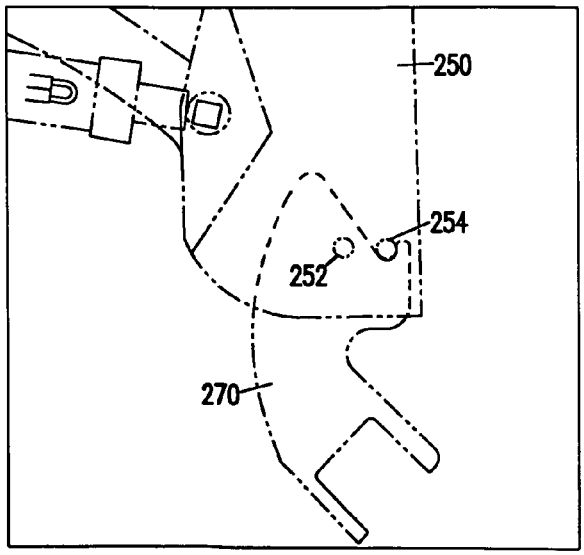
Figure 10A:
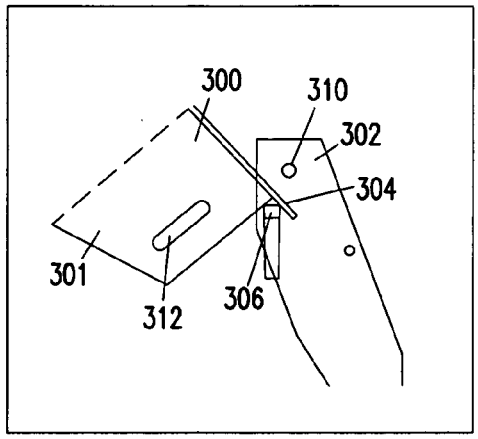
FIGS. 10(*a*)–(*d*) is a side view showing the attachment of a tower to a rear bracket according to principles of the invention.
Figure 10B:
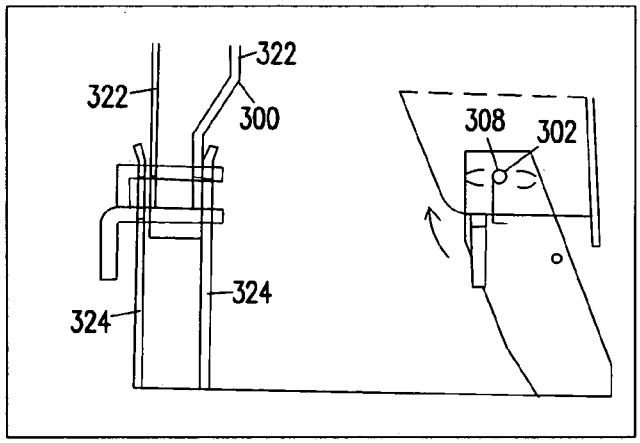
Figure 10C:
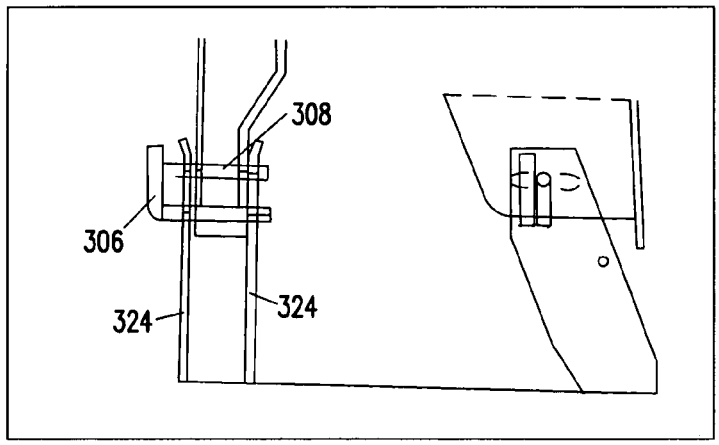
Figure 10D:
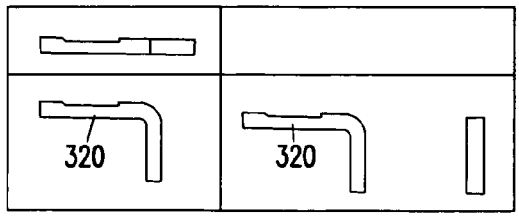

Alternative techniques for attaching the tower to the rear bracket assembly are exemplified in FIGS. 8–10. The technique shown in FIGS. 8(*a*)–(*c*) is similar to the technique identified above with respect to FIGS. 6 and 7. The bracket 200 is provided attached to a tractor, and includes a shoe-receiving area 202. The tower 204 is provided with a shoe area 206 that fits over the shoe-receiving area 202. The shoe area 206 includes a bottom opening 208, and the tower 204 includes at least three sides. The first side 210 is shown, the second side is opposite the first side 210, and the third side 212 is shown. The tower 204 includes a fixed pin 214, and an opening 216. As the bottom opening 208 fits over the shoe-receiving region 202, the fixed pin 214 engages the receiving surface 220 and moves along the receiving surface 220 until it reaches the pin receiving area 222. The tower 204 continues to rotate until it is positioned correctly, both horizontally and vertically, over the shoe-receiving area 202. A removable pin can then be inserted through the opening 216 and the opening 224. The openings 216 and 224 are shown aligned in FIG. 8(*c*).

Now referring to FIG. 9, a tower 250 is provided having two fixed pins 252 and 254. The fixed pin 252 engages the receiving surface 256 and follows the receiving surface 256 until it engages the first fixed pin receiving area 258. The tower 250 continues to rotate until the second fixed pin 254 engages the second fixed pin receiving area 260. The tower 250 is then held over the shoe-receiving region 270 by the attachment of the attachment arm to the front bracket assembly.

Now referring to FIGS. 10(*a*)–(*d*), an additional embodiment showing the attachment of the tower 300 to a bracket assembly 302 is provided. FIGS. 10(*b*) and (*c*) include front and side views. In this embodiment, the tower 300 includes a shoe area 301 that fits and is received within the bracket assembly 302. The tower includes a receiving surface 304 that engages a rotation pin as the tower 300 rotates into the bracket assembly 302. The rotation pin 306 guides the tower 300 into position within the bracket assembly 302 as the tower 300 continues to rotate. Once the tower 300 is provided in the appropriate position, a removable pin 308 is then inserted within the opening 310 provided in the bracket assembly 302 and the opening 312 provided in the tower. The rotation pin 306 can then be rotated in the direction shown by the arrow to lock the tower 300 in place. The rotation pin 306 preferably includes a cam region 320 which, when the rotation pin 306 rotates, causes a compression of the tower walls 322 against the bracket assembly walls 324.

Figure 11:
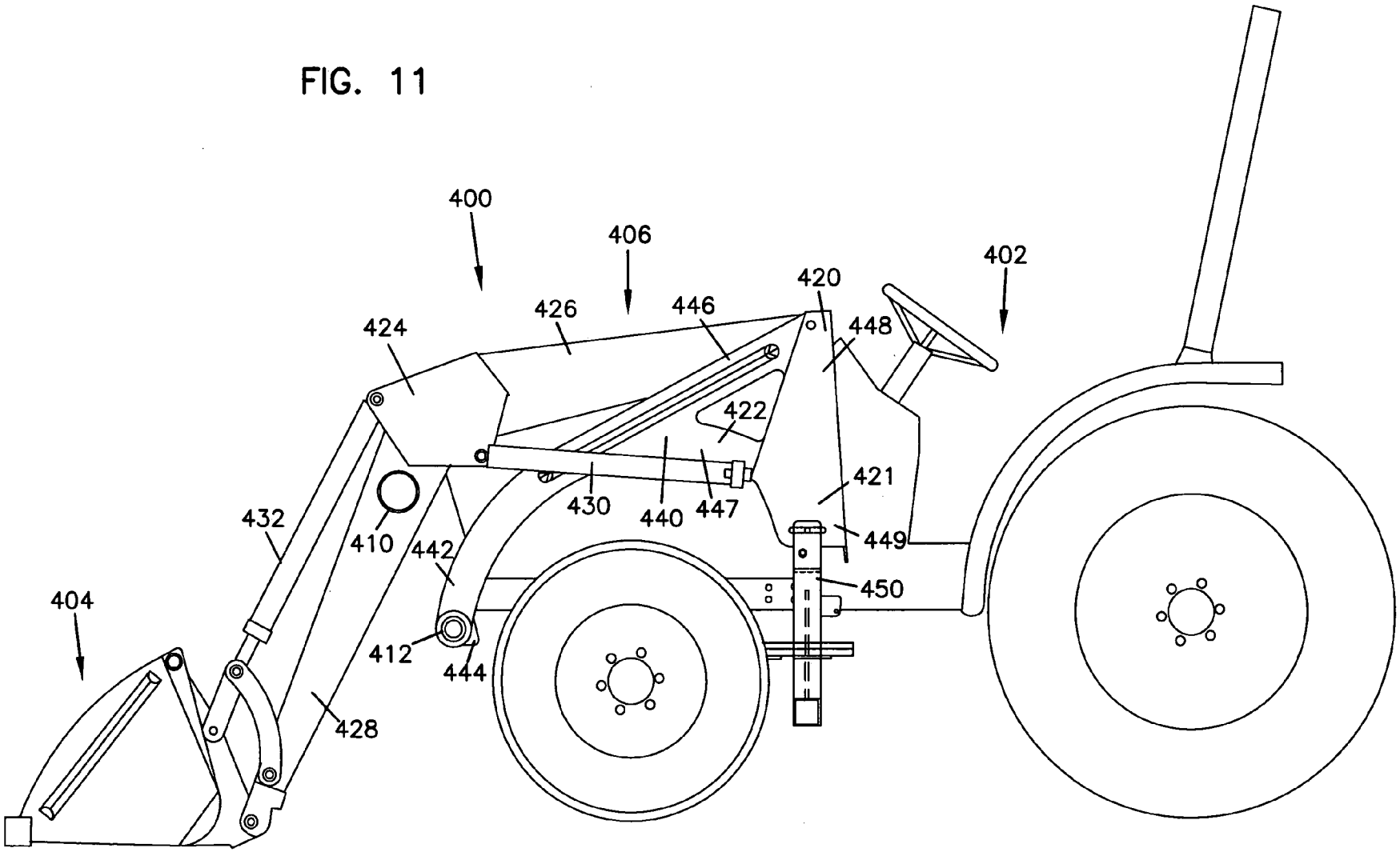
FIG. 11 is a side view of a tractor having an alternative embodiment of a front end loader mounted thereon according to the principles of the invention.
Figure 12A:
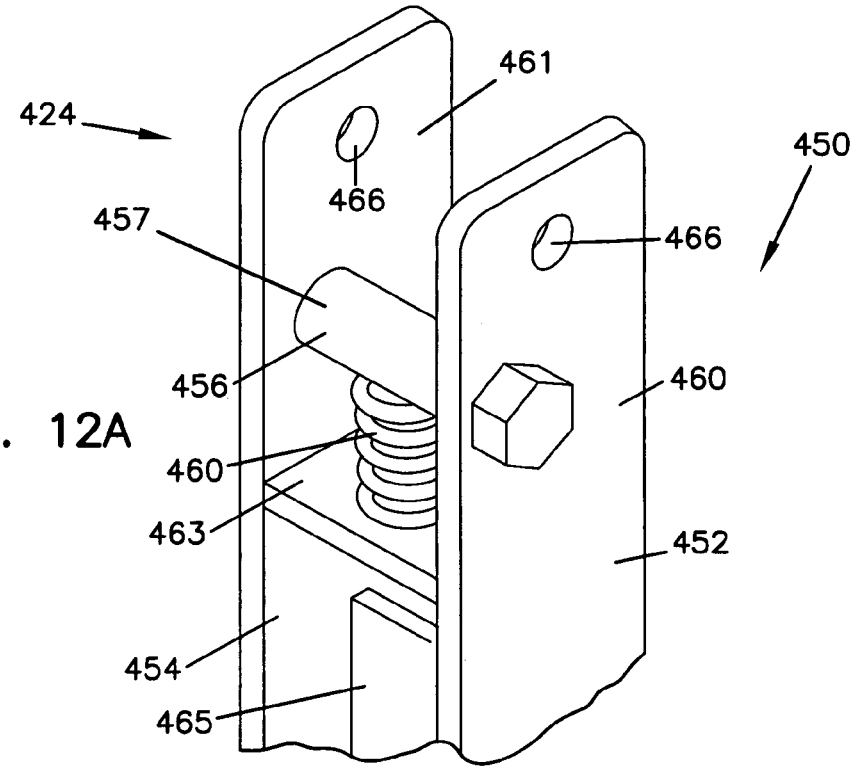
FIGS. 12(*a*)–(*d*) is a side view of the tractor and front end loader of FIG. 11 showing the attachment of a tower to a rear bracket according to the principles of the invention.
Figure 12B:
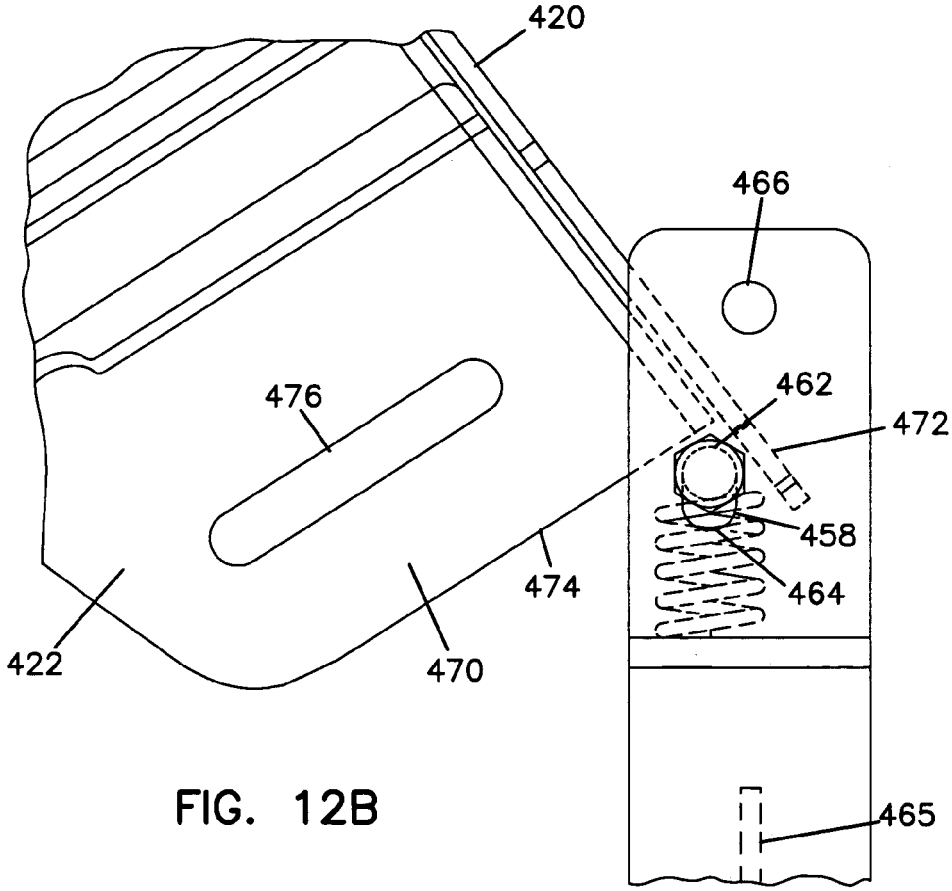
Figure 12D:
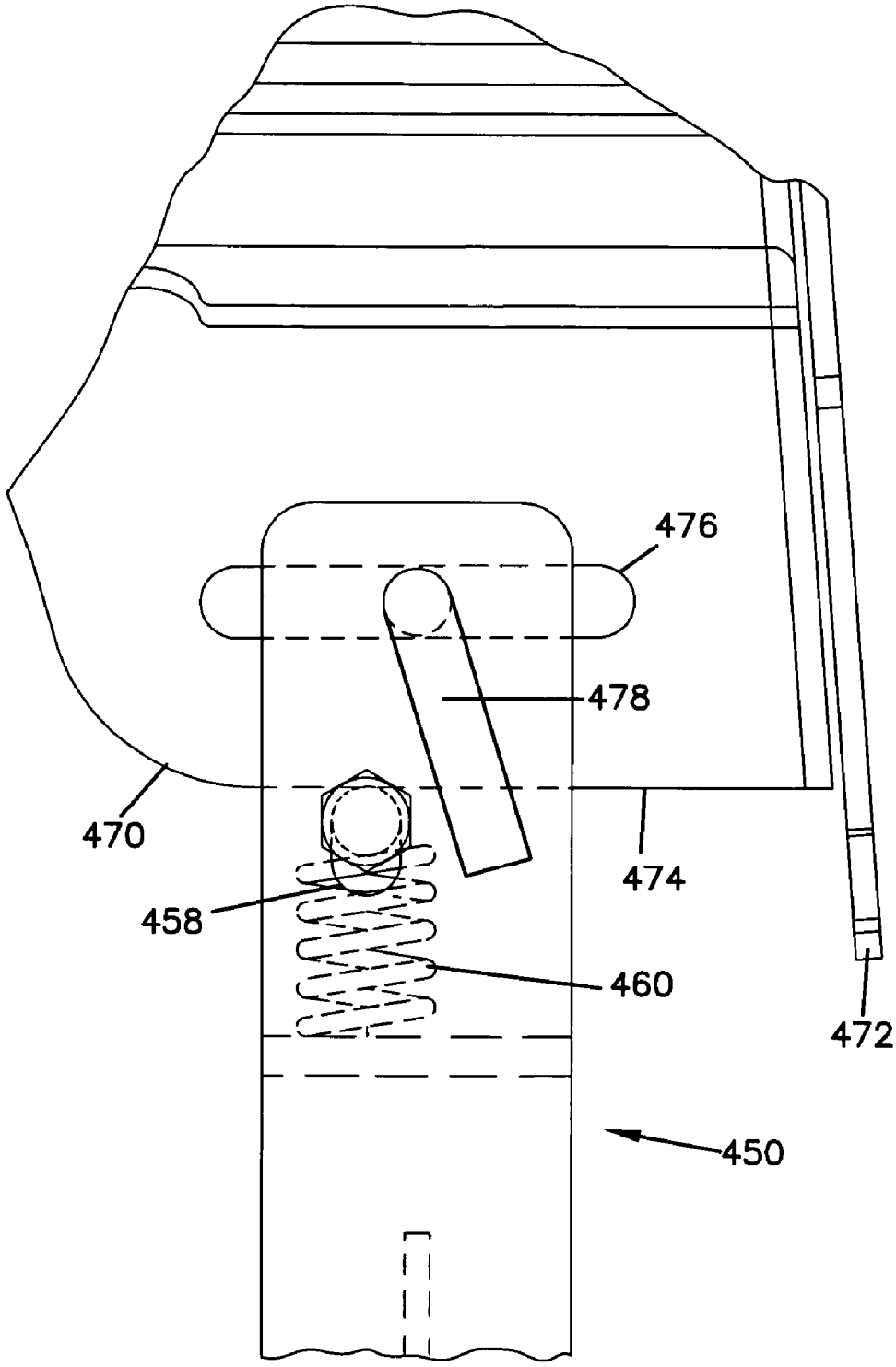

Now referring to FIGS. 11 and 12(*a*)–(*d*), an additional embodiment of a front end loader 400 is shown attached to a tractor 402 and an attachment 404. The front end loader 400 includes a left boom arm 406 and a right boom arm (not shown). In general, the left boom arm and the right boom arm can be provided having a generally similar construction. A stabilizing arm 410 and an attachment arm 412 extend between the left boom arm and the right boom arm. The left boom arm 406 includes a tower 420, a tower subframe 422, a knee 424, a loader arm 426, a front arm 428, a lift cylinder 430, and an attachment cylinder 432. The tower 420 and the tower subframe 422 are attached together. The tower subframe 422 includes a first tower subframe end 440 that attaches to the tower 420, and a second tower subframe end 442 that attaches to the attachment arm 412. The attachment arm 412 is provided for attaching to the front bracket assembly 444 provided on the tractor 402. The front bracket assembly 444 can be referred to as the second bracket assembly and is provided attached to the tractor. The first tower subframe end 440 includes a first tower subframe arm 446 that attaches to the first tower end 448, and a second tower subframe arm 447 that attaches to the second tower end 449. The tower subframe 422 assists with the connection of the attachment arm 412 to the front bracket assembly 444 and the tower 420 to the rear bracket assembly 450. The rear bracket assembly 450 can be referred to as the first bracket assembly and is provided attached to the tractor.

The front end loader 400 attaches to the tractor 402 by first attaching the attachment arm 412 to the front bracket assembly 444. The fastening of the attachment arm 412 to the front bracket assembly 444 can be accomplished in a manner similar to that described in the context of FIGS. 4 and 5. As the tractor 402 moves forward and/or as the lift cylinder 430 extends, the front end loader 400 rotates relative to the rear bracket assembly 450 until the tower 420 fits within the rear bracket assembly 450. The tower 420 can be constructed so that it fits in and is received within the first wall 452 and the second wall 454 of the rear bracket assembly 450. The separation between the first wall 452 and the second wall 454 can be provided by a distance sufficient to receive the tower 420 therein. The second tower end 449 can be characterized as including a shoe area 422 that fits between the first wall 452 and the second wall 454 of the rear bracket assembly 450. The portion of the rear bracket assembly 450 that receives the tower 420 can be referred to as the shoe receiving region 424.

The rear bracket assembly 450 includes a pin 456 provided within a slot 458 extending through the first and second walls 452 and 454. The pin 456 can be referred to as a rotation pin 457 when it is provided as a pin that rotates relative to the first and second walls 452 and 454 to help assist with the movement of the tower 420 thereover. The rear bracket assembly 450 additionally includes a spring 460 that biases the pin 456 toward the distal end 462 of the slot 458 and away from the proximal end 464 of the slot 458. It should be understood that the term distal refers to the slot end farthest away from the spring 460, and the term proximal refers to the portion of the slot closest to the spring 460. In general, the distal end 462 can be considered the top end of the slot 458 and the proximal end 464 can be considered the bottom end of the slot 458 when the spring 460 is configured to bias the pin 456 upwards. The pin 456 can be considered a fixed pin because it is generally not removed from its position extending between the first and second wall 452 and 454. The rear bracket assembly 450 includes a spring platform 463 that provides a surface against which the spring 460 presses to bias the pin 456 upwards. The platform 463 can be provided extending between the first and second walls 452 and 454. In addition, a center support member 465 can be provided to support the first and second walls 452 and 454. The rear bracket assembly additionally includes a removable pin hole 466 that extends through the first and second walls 452 and 454. A removable pin 478 is intended to be inserted through the removable pin hole 466 provided in first and second walls 452 and 454.

As the lift cylinder 430 is extended, the rear bracket assembly 450 engages the tower 420 along the tower bottom end 470. In general, the tower bottom end 470 includes an extension arm 472 that extends away from the tower bottom resting surface 474. The extension arm 472 can be provided as a catch for receiving the pin 456 and allowing the tower to rotate about the pin 456. As the tower continues to rotate, the tower resting surface 474 begins to rest on the pin 456, and the removable pin slot 476 in the tower 420 becomes aligned with the removable pin hole 466. As the slot 476 becomes aligned with the removable pin hole 466, the removable pin 478 can be inserted in order to hold the tower 420 in place relative to the rear bracket assembly 450. It should be understood that the removable pin slot 476 is simply a hole constructed to receive the removable pin 478.

By extending the lift cylinder 430, the tower 420 compresses the spring 460 until the removable pin slot 476 becomes aligned with the removable pin hole 466. The removable pin 478 can then be inserted into the removable pin slot 476 and the removable pin hole 466. By retracting the lift cylinder 430, the spring 460 provides some degree of cushion that reduces a rattle as a result of the tower bottom resting surface 474, the pin 456, and the slot 458. In addition, it should be appreciated that the lift cylinder 430 can generally be used for attaching and aligning the tower 420 with the rear bracket 450 once the tower subframe 422 is attached at the front bracket assembly 444. The removable pin slot 476 can be configured as a slot rather than as a circular hole in order to assist with matching up with the removable pin hole 466.

The spring 460 helps eliminate a rattle or vibration sound that may be found in the absence of the spring. That is, the spring 460 applies a biasing pressure against the pin 456 that helps reduce rattle between the pin 456 and the tower bottom surface 474 and/or between the pin 456 and the slot 458. Although the spring 460 is shown in a construction where the shoe area 422 fits within a shoe receiving area in a rear bracket assembly, it is pointed out that a spring can be used in other embodiments where the shoe area fits over and outside of a shoe receiving area in a rear bracket assembly.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A front end loader comprising:

(a) a first bracket assembly constructed for attachment to a tractor, and comprising a shoe-receiving region comprising a slot having a distal end and a proximal end, a pin provided within the slot, an insertion pin hole, and a spring constructed to bias the pin toward the distal end of the slot;

(b) a second bracket assembly comprising a bracket member constructed for attachment to a tractor, and a receiving area constructed for attachment to tower subframe;

(c) a tower having a first tower end and a second tower end;

(i) the second tower end including a shoe area constructed to fit within the shoe-receiving region of the first bracket assembly;

(ii) the shoe area comprising an arm constructed for engaging the pin provided within the first bracket assembly, and a resting surface for resting on the pin; and (iii) the shoe area comprising an opening for receipt of an insertion pin for securing the tower to the first bracket assembly; and (d) a tower subframe having a first tower subframe end and a second tower subframe end;

(i) the first tower subframe end being attached to the tower; and (ii) the second tower subframe end being constructed for attachment to the receiving area of the second bracket assembly.

2. A front end loader according to claim 1, wherein the pin is constructed to rotate.

3. A front end loader according to claim 1, wherein the shoe-receiving region comprises a first wall and a second wall, and the pin extends between the first wall and the second wall.

4. A front end loader according to claim 1, wherein the tower subframe comprises an attachment arm, and the receiving area of the second bracket assembly is constructed for attachment to the attachment arm.

* * * * *